US006332068B2

(12) United States Patent
Blackman et al.

(10) Patent No.: US 6,332,068 B2
(45) **Date of Patent: *Dec. 18, 2001**

(54) PRINT RECORDING APPARATUS HAVING MODULAR AUTODUPLEX MECHANISM

(75) Inventors: Jeffrey R. Blackman, Vancouver; Thomas W. Ruhe, La Center; Larry A. Jackson; Thomas E. McCue, Jr., both of Vancouver; Kevin O'Hara, Washangal, all of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/740,659

(22) Filed: Dec. 18, 2000

Related U.S. Application Data

(63) Continuation of application No. 09/283,107, filed on Mar. 31, 1999, now Pat. No. 6,167,231.

(51) Int. Cl.[7] ..... G03G 15/00

(52) U.S. Cl. ..... 399/364; 400/639; 400/692; 400/578; 399/367; 399/401; 399/110; 399/111; 399/113; 355/24

(58) Field of Search ..... 400/578, 634, 400/636, 692, 637, 637.1, 691, 88; 355/24; 399/45, 364, 369, 373, 367, 401, 402, 110, 111, 113, 309, 374; 347/104; 271/3.1

(56) References Cited

U.S. PATENT DOCUMENTS

| | | | | |
|---|---|---|---|---|
| 3,972,612 | | 8/1976 | Komori et al. . | |
| 4,327,905 | * | 5/1982 | Schonfeld | 271/3.1 |
| 4,348,101 | * | 9/1982 | Schonfeld et al. | 355/23 |
| 4,362,379 | * | 12/1982 | Tiek et al. | 399/364 |
| 4,607,948 | * | 8/1986 | Naito | 399/364 |
| 4,645,195 | | 2/1987 | Scranton et al. . | |
| 4,674,857 | | 6/1987 | Satomura et al. . | |
| 4,777,498 | | 10/1988 | Kasamura et al. . | |
| 4,787,616 | | 11/1988 | Sasaki et al. . | |
| 4,811,049 | * | 3/1989 | Honjo | 355/24 |
| 4,825,245 | | 4/1989 | Fukae et al. . | |
| 4,845,528 | | 7/1989 | Aoki et al. . | |
| 4,855,790 | * | 8/1989 | Suzuki | 355/24 |
| 4,884,110 | * | 11/1989 | Tsurubuchi | 271/3.1 |
| 4,918,490 | * | 4/1990 | Stemmle | 355/24 |
| 4,924,275 | * | 5/1990 | Nelson | 399/401 |
| 4,928,127 | * | 5/1990 | Stemmle | 399/364 |
| 4,935,786 | * | 6/1990 | Veeder | 399/401 |
| 4,974,033 | * | 11/1990 | Yamada | 399/401 |
| 5,073,803 | * | 12/1991 | Kato et al. | 355/24 |
| 5,089,858 | | 2/1992 | Ohno et al. . | |
| 5,095,371 | * | 3/1992 | Tanaka et al. | 399/364 |
| 5,485,261 | * | 1/1996 | Kuroda | 355/24 |
| 5,836,706 | * | 11/1998 | Ruhe | 399/401 |
| 5,991,592 | * | 11/1999 | Kobayashi et al. | 399/364 |

(List continued on next page.)

OTHER PUBLICATIONS

Hewlett Packard, "LaserJet 4000T Engine with Duplexer Unit," 6 pages; Disclosed 10/97.

*Primary Examiner*—Eugene Eickholt

(57) ABSTRACT

A modular duplex media handling system is installable for use with a print recording system having a simplex media handling system. During first side printing a media sheet is fed along a first media path in the simplex system from feed rollers to metering rollers and into a print zone. After first side printing and prior to releasing the media sheet, the metering rollers feed the media sheet back along the first media path to the feed rollers. The feed rollers in turn feed the media sheet completely into the duplex module where the media moves along a loop path (in effect flipping the media sheet). The media sheet then is fed back to the feed rollers and along the first media path for second side printing. A humidity sensor in the duplex module signals to the print recording system whether the duplex handling system is installed.

33 Claims, 4 Drawing Sheets

U.S. PATENT DOCUMENTS 6,018,640 * 5/1999 Blackman et al. ..... 399/364
6,018,688 * 6/2000 Okada et al. ..... 399/367
6,029,020 * 3/1999 Blackman et al. ..... 399/45
6,047,959 * 8/2000 Baba et al. ..... 399/367
6,048,060 * 4/2000 Nurushma et al. ..... 347/104
6,167,231 * 12/2000 Blackman et al. ..... 400/578

* cited by examiner

FIG. 4
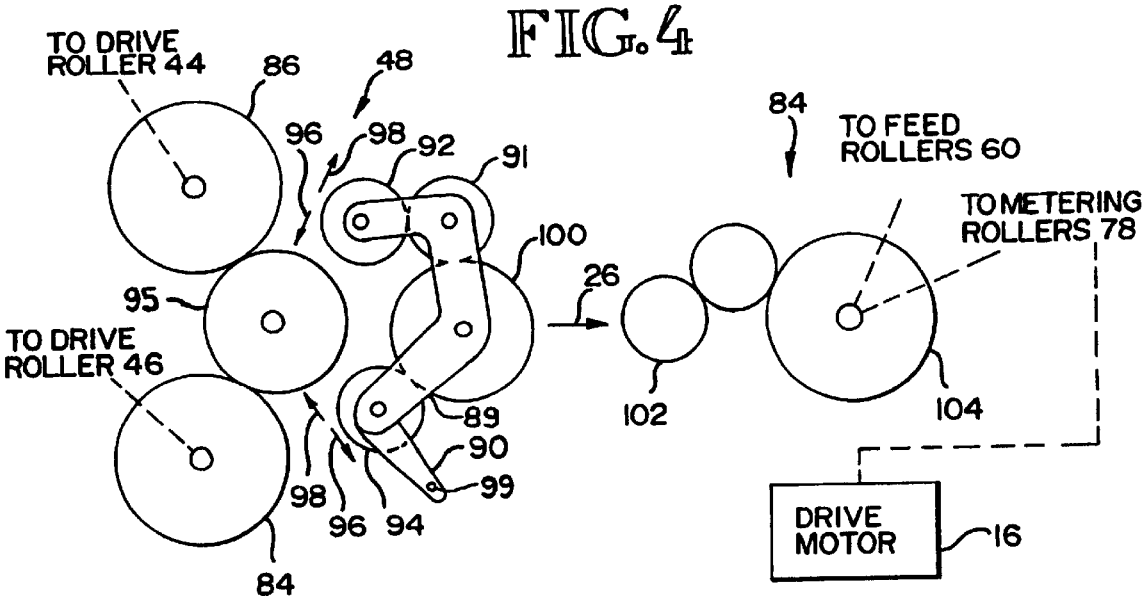
FIG. 5
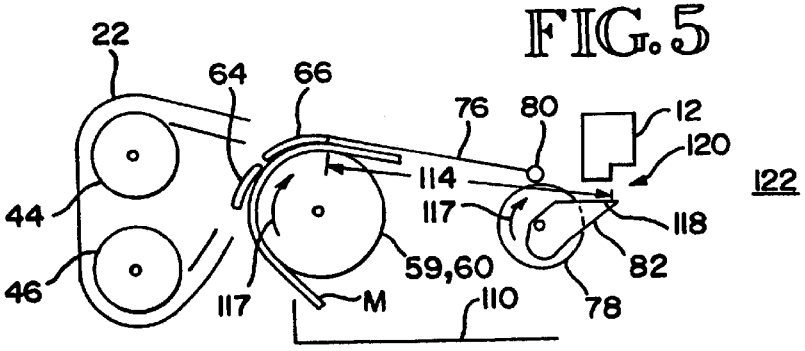
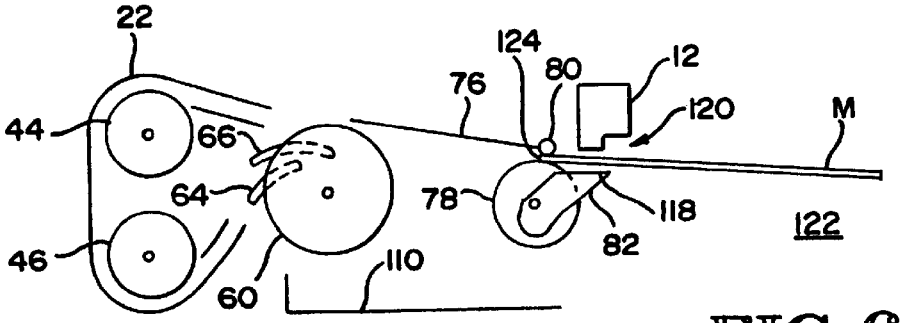
FIG. 6

PRINT RECORDING APPARATUS HAVING MODULAR AUTODUPLEX MECHANISM

CROSS REFERENCE TO RELATED APPLICATION(S)

This is a continuation of application Ser. No. 09/283,107 filed on Mar. 31, 1999; now U.S. Pat. No. 6,167,231.

BACKGROUND OF THE INVENTION

This invention relates generally to methods and apparatus for printing on two sides of a media sheet, and more particularly, to a media handling system which first feeds a media sheet with a first side exposed to a print source, then feeds the media sheet with a second side exposed to the print source.

Printing to two sides of a media sheet, referred to as duplex printing, is a desirable feature in printing systems. The advantages of duplex printing include reducing the amount of paper required compared to one-sided (simplex) printing, and generating print sets with layouts resembling that of professionally printed books. Conventional duplex printing devices employ complex paper handling mechanisms. Typically, an extra tray is used for temporary storage of pages having printing on a first side. In an alternative approach a second paper path is provided to route a first printed page around the existing paper supply.

Similarly, duplex copying typically is accomplished by either one of two methods. In one method, first side copies are stacked in a duplex tray. When a set of first side copies is complete, the copies are fed out of the duplex tray and returned with an odd number of inversions along a duplex path to receive second side imaging. In an alternative method first side copies are returned directly to receive second side imaging without stacking.

Conventional devices tend to have long paper paths and many parts. A substantial challenge with systems having these complex duplex printing paper paths is handling paper jams. Accordingly, there is a need for a simplified method and apparatus for duplex media handling at a desktop print recording device.

SUMMARY OF THE INVENTION

According to the invention, a modular duplex media handling system is used in conjunction with a simplex media handling print recording apparatus. The simplex media handling system includes firmware for operating either in a simplex mode or in a duplex mode, (where the modular duplex media handling system is installed to operate in duplex mode).

According to one aspect of the invention, the duplex media handling system is removable to allow for easy cleaning of the simplex media handling system, the print recording system, and the duplex media handling system. Another benefit is that the modular duplex media handling system can be used with different print recording systems. A pivoting cover also is included to allow access into the duplex handling paper path to clear paper jams.

The host print recording system includes the simplex media handling system and a recording print source. The simplex media handling system includes feed rollers and metering rollers. A media sheet is fed from an input tray along a first media path from the feed rollers to the metering rollers, onward into a print zone adjacent to the print recording source. The media sheet is fed through the print zone into an output tray.

During duplex operations, the metering roller stops prior to releasing the media sheet into the output tray. While the metering roller still engages a trailing edge of the media sheet, the metering roller reverses direction to move the media sheet back along the first media path onto the feed roller. According to another aspect of the invention, the feed roller, rotating with the metering rollers in the reverse direction, moves the media sheet into the modular duplex handling system. The media sheet is flipped by the modular duplex handling system, which feeds the media sheet back to the feed roller. The feed roller rotating once again in the forward direction moves the flipped media sheet along the first paper path to the metering roller and into the print zone for second side printing. The flipped media sheet is fed through the print zone and released into the output tray.

According to another aspect of this invention, the feed roller and metering roller are commonly linked to rotate only in the same direction. An advantage of such a common rotational direction is that the gearing for the rollers is simple and less costly than for systems where the feed rollers and metering rollers rotate in a common direction at one time and in opposite directions at another time.

According to another aspect of the invention, the modular duplex media handling system includes a pair of drive rollers defining a loop media path. Both the entrance and the exit to the duplex media handling system are located adjacent to the feed roller of the print recording system.

According to another aspect of the invention, the modular duplex handling system also includes linkage to the print recording system drive motor. The drive motor drives all of the feed roller, the metering roller and the pair of duplex handling drive rollers. In addition, the duplex media handling system includes a transmission apparatus which allows the drive rollers to be disengaged, engaged for rotation in the same direction as the feed roller, or engaged for rotation in the opposite direction as the feed roller. The drive rollers rotate in a common direction (not opposing directions), relative to each other.

According to another aspect of the invention, the media sheet is moved through the duplex media handling system in a one-way path, (i.e., the loop media path). Thus, the duplex handling system rollers rotate in one direction. However, at one point during the media flipping process, the duplex handling system rollers are rotating in the same direction as the feed roller, while at another point during the media flipping process, the duplex system rollers are rotating in the opposite direction as the feed roller. The transmission operates to determine whether the drive rollers rotate in the same direction as the feed rollers, or in the opposite direction of the feed rollers.

According to another aspect of this invention, for an inkjet printing embodiment the media dry time for second side printing is the summation of the first and second side printing times of the next sheet.

According to another aspect of the invention, a humidity sensor is included with the modular duplex media handling system. Such a sensor also serves to signify to the print recording system whether the duplex handling system is installed or not installed. When installed, the print recording system reads the humidity sensor allowing determination of a sufficient dry time during first side printing (before allowing the media sheet to be fed through the duplex handling system for media flipping). First side drying time is dependent upon the media, the environment and the amount of ink. An advantage of the humidity sensor's dual functions is that the print recording system firmware may be the same for systems with and without the modular duplex handling system installed.

One advantage of the invention is that automatic media flipping is accomplished without user intervention. Another advantage is that the duplex handling system can be removed and installed as desired. Another advantage is that additional motors are not needed for the module. The duplex module is powered by the simplex media handling system. Another advantage is that additional media position sensors are not required for the duplex module. The media position sensors of the simplex media handling system are provide the sensing for controlling media moving through the duplex module. These and other aspects and advantages of the invention will be better understood by reference to the following detailed description taken in conjunction with the accompanying drawings.

BRIEF DESCRIPTION ODE DRAWINGS

FIG. 4 is a diagram of the duplex media handling system transmission and the simplex media handling system gear linkage of FIG. 3 according to one embodiment of this invention;

FIG. 5 is a diagram of the duplex media handling system and simplex media handing system during the pick and feed of a media sheet;

FIG. 6 is a diagram of the duplex media handling system and simplex media handing system at the completion of first side printing where the rollers are stopped with the media sheet trailing edge gripped by the metering rollers;

Figure 9:
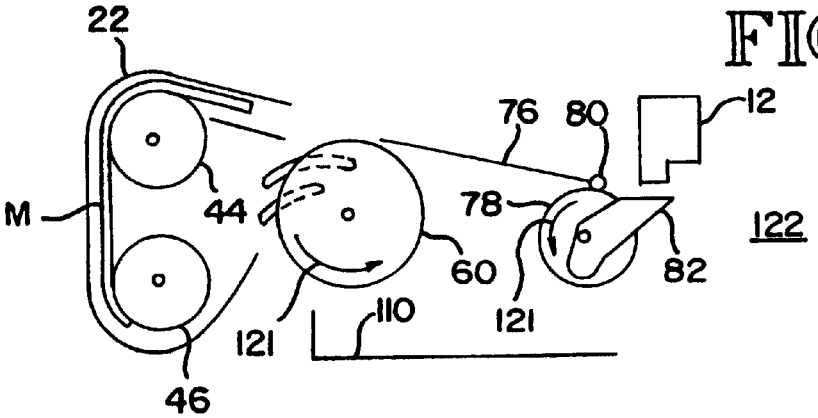
Figure 10:
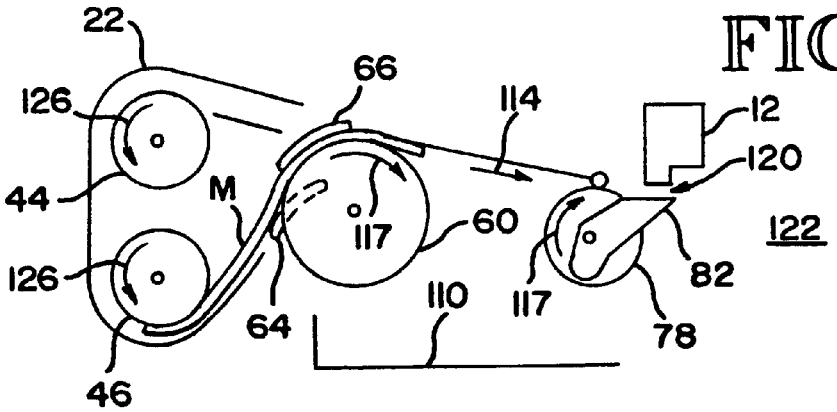

FIG. 9 is a diagram of the duplex media handling system and simplex media handing system during a jogging operation of the duplex media handling system transmission; and FIG. 10 is a diagram of the duplex media handling system and simplex media handing system during feeding of the media sheet from the duplex media handling system back to the simplex media handling system for second side print recording.

DESCRIPTION OF SPECIFIC EMBODIMENTS

Overview

Figure 1:
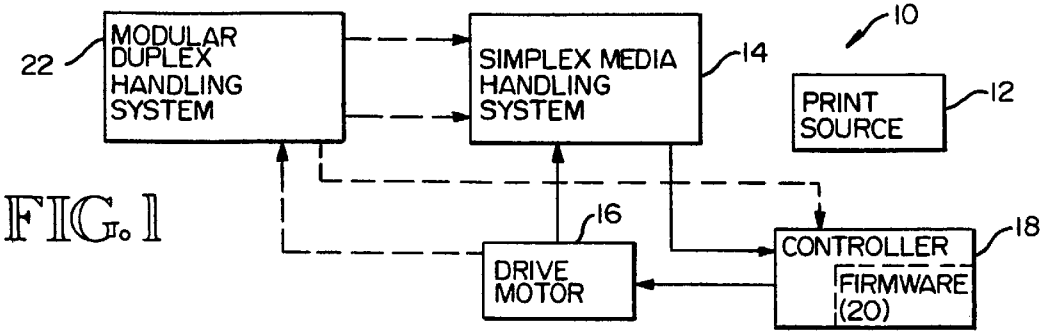
FIG. 1 is a block diagram of a print recording system according to an embodiment of this invention.

Referring to FIG. 1, a print recording system 10 includes a print source 12, a simplex media handling system 14, a drive motor 16 and a controller 18 with firmware 20. Also included in the system 10 is a modular duplex media handling system 22. The duplex media handling system 22 is removable, allowing the system 10 to be customized for simplex printing models and duplex printing models.

Figure 2:
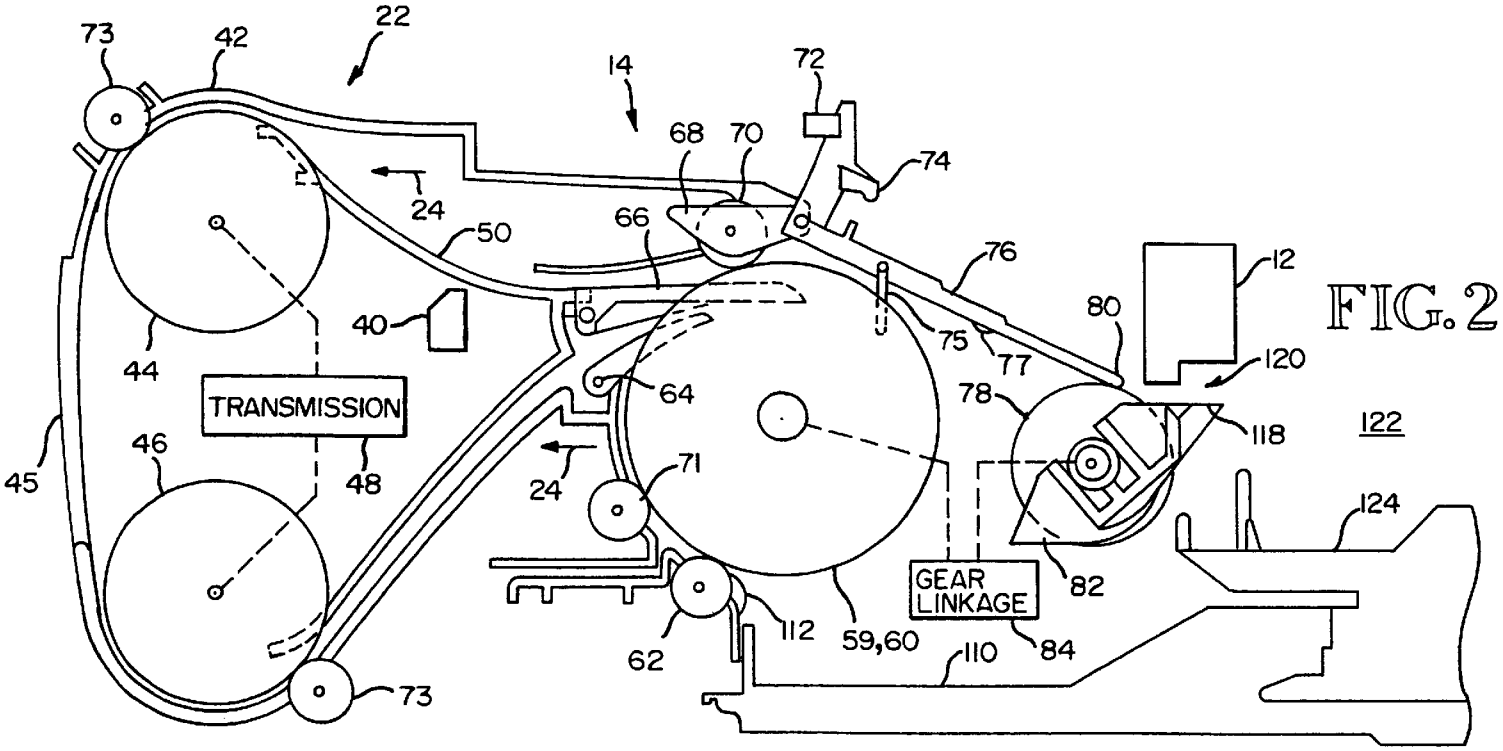
FIG. 2 is a planar view of a portion of the simplex media handling system and modular duplex handling system of FIG. 1 according to an embodiment of this invention.
Figure 3:
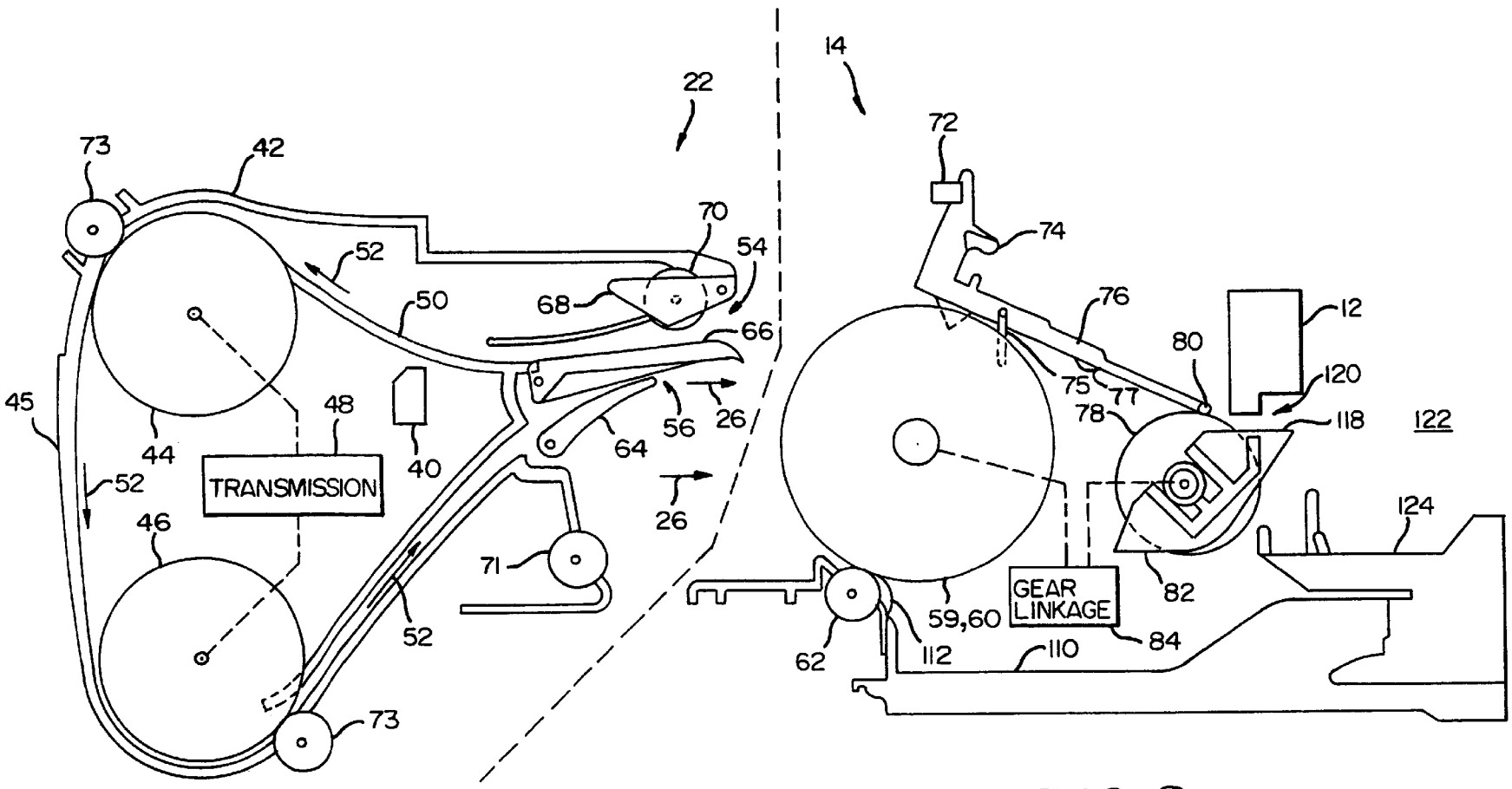
FIG. 3 is an exploded planar view of the duplex handling system separated from the simplex handling system of FIG. 2 according to an embodiment of this invention.

Referring to FIG. 2, the print source 12, simplex media handling system 14 and duplex media handling system 22 are shown for an inkjet printer embodiment. FIG. 3 shows the same structure with the duplex handling system 22 detached. The duplex media handling system 22 is easily removed by sliding the module 22 in direction 24 (see FIG. 2), then lifting the module away from the simplex media handling system 14. The duplex media handling system 22 is installed by removing a rear access door, then lowering the system 22 into a housing unshown for the print recording system 10. The duplex media handling system 22 then is slid in direction 26 (see FIG. 3) toward the simplex media handling system 14. The duplex media handling system 22 engages to the simplex media handling system 14 using the same mechanical interface as was used for the removed rear access door.

The duplex media handling system 22 includes a sensor 40 which interfaces with the controller 18, allowing the controller 18 to detect whether the duplex media handling system 22 is present in the print recording system 10. An electrical, electro-mechanical and/or electro-optical connection is included to interface the sensor 40 output with the controller 18. The controller 18 tests to determine whether the duplex media handling system 22 is installed. Specifically, if a sensor 40 signal is present, then the system 22 is installed (since the sensor is part of the system 22). In response, the controller 18 firmware 20 enables both simplex printing and duplex printing operations. If a sensor 40 signal is not present, then the controller 18 firmware 20 disables duplex printing operations and allows simplex printing operations.

In operation the print recording system 10 receives a media sheet upon which text, graphics or other symbols are to be recorded. For example, in an inkjet printer embodiment the printer receives a print job from a host computer (not shown). The controller 18 controls the drive motor 16 and print source 12 coordinating the movement of the media sheet relative to the print source 12. For single-sided (i.e., simplex) printing, the media sheet is fed through the simplex media handling system 14 adjacent to the print source 12 where the text, graphics or other symbols are recorded on the media sheet. For duplex printing, the media sheet is fed through the simplex media handling system 14 along a media path to perform first-side printing. The media sheet then is fed back along a portion of the media path into the duplex handling system 22 which flips the media sheet, then returns the media sheet to the simplex media handling system 14 for second side printing.

Referring to FIG. 3, the duplex media handling system 22 includes the sensor 40, a frame 42, a pair of drive rollers 44, 46, a transmission 48, flip guides 64, 66, pinch rollers 70, 71, 73, and roller sleds 68. The transmission 48 is coupled to the print recording system's drive motor 16. During duplex printing, a media sheet is fed within the duplex media handling system 22 along a loop media path 52. The media sheet is received at flip guide 66 and fed by the simplex media handling system 14 along a paper guide 50 of the frame 42 toward the first drive roller 44. The drive roller 44 moves the media sheet along the path 52 to the second drive roller 46, which in turn, moves the media sheet out of the modular duplex handling system 22 back to the simplex media handling system 14. The duplex module media path 52 is a loop having an entry point 54 in the vicinity of the exit point 56. Both the entry point 54 and the exit point 56 are adjacent to a common area of the simplex media handling system 14.

Referring to FIGS. 2 and 3, the simplex media handling system 14 includes pick roller 59, feed rollers 60, feed idlers 62, a media sensor 72, flag 74, secondary flag 75, an upper guide 76, and metering rollers 78 with another set of pinch rollers 80, a pivot mechanism 82 and gear linkage 84. The drive motor 16 (see FIG. 1) is coupled to the feed rollers 60 and metering rollers 78 through the gear linkage 84. An opening is included for receiving the duplex media handling system 22.

Referring to FIG. 4, the gear linkage 84 of the simplex media handling system 14 is coupled to the transmission 48 of the duplex media handling system. The transmission 48 and gear linkage 84 couple the drive rollers 44, 46 to the drive motor 16. The transmission 48 includes a first drive gear 86 for the first drive roller 44 and a second drive gear 88 for the second drive roller 46. Through a subset of gears 86, 88, 91,92,94,95, and 100, the transmission 48 engages the drive rollers 44,46.

Gear 100 serves as a coupling gear which links the transmission 48 to the gear linkage 84 of the simplex media handling system (e.g., at gear 102). Gear 100 is driven by the drive motor 16 through the gear linkage 84. Transmission gears 91, 92, and 94 are coupled to gear 100, and are mounted to a gear mount 89. The rotation of gear 100 causes the gears 91, 92 and 94 and gear mount 89 to move about the gear 100 in one of two directions 96,98. Movement of the gears 91, 92,94 in direction 96 brings gear 92 into engagement with gear 95, and gear 94 out of engagement with gear 95, causing drive gears 86, 88 to rotate in the opposite direction. In this engagement of gears 92 and 95, the transmission 48 is considered to be in first gear. Movement of the gears 91,92, 94 in direction 98 brings gear 94 into engagement with gear 95, and gear 92 out of engagement with gear 95, causing drive gears 86, 88 to rotate in one direction. In this engagement of gears 94 and 95, the transmission 48 is considered to be in second gear. In first gear, the drive rollers 44,46 rotate in the same direction as the feed rollers 60 and metering rollers 78 of the simplex media handling system. In second gear, the drive rollers 44, 46 rotate in the opposite direction as the feed rollers 60 and metering rollers 78 of the simplex media handling system.

When the duplex media handling system is installed, gear 100 engages the gear linkage 84 of the simplex media handling system 14 at an interface gear 102. Gear linkage 84 also includes a drive gear 104 which is coupled to the drive motor 16 through a linkage included to drive the feed rollers 60 and metering rollers 78.

The transmission 48 also includes a clutch 90 which is coupled at one end to gear 94. The other end of the clutch 90 includes a protrusion 99 which moves within a cam track (not shown). When the transmission 48 is in neutral, the protrusion 99 sits in a fixed location (e.g., a V-lock groove) of the cam track It takes a change of direction of gear 100 to move the protrusion out of the V-lock. A gear change (one of gear 92,94 engaging gear 95) may then occur. Note that the clutch 90 moves with gear 94 in the directions 96,98. When gear 92 is engaged or gear 94 is engaged, the protrusion 99 does not come to rest in the V-lock. It is when the transmission 48 is in neutral, that the protrusion 99 sits in the V-lock.

To switch gears from engagement of gear 94 with gear 95 to neutral (the position illustrated in FIG. 4), the drive motor 16 stops driving gear 100, then restarts driving gear 100 in the opposite direction. This moves the gear 94 in direction 96 and brings the clutch 90 to rest in neutral (protrusion 99 sits in the V-lock). This is referred to as a stop and start action. To continue on switching gears to bring gear 92 into engagement with gear 95, the direction of gear 100 is changed again to allow the clutch 90 to come out of neutral, then the direction is changed one more time to move the gears 92, 94 and clutch 90 further along in direction 96. This brings gear 92 into engagement with gear 95. The actions to switch from neutral to engagement of gear 92 (or gear 94) with gear 95 is called a jogging action.

In a preferred embodiment the feed rollers 60 and metering rollers 78 are driven in a common direction during simplex or duplex media handling. That common direction changes during duplex printing, but is the same for the feed rollers 60 and metering rollers 78. Depending on the position of gears 92, 94, the drive rollers 44, 46, while engaged, rotate in either the same direction as the feed rollers 60/ metering rollers 78 or in the opposite direction as the feed rollers 60/ metering rollers 78. While the drive rollers 44,46 are engaged, one drive roller 44/46 always rotates in the same direction as the other drive roller 46/44. The specific gear linkages for the transmission 48 and linkage 84 may vary depending on the specific embodiment. For example the relative positioning and size of the simplex media handling system 14 and duplex media handling system 22 may vary, resulting in differing transmission 48 and linkage 84 embodiments.

Operation

The media handling operations for simplex and duplex media recording are described with regard to FIGS. 5–10. For either simplex or duplex print recording, a media sheet M is lifted into contact with a pick roller 59. The top sheet M is picked from a stack of media sheets in an input tray 110. Excess sheets are retarded by a restraint pad system 112 (see FIGS. 2, 3). Referring to FIGS. 2 and 5 the picked media sheet M is fed around feed rollers 60. The feed idlers 62 and pinch rollers 70, 71 press the media sheet to the feed and pick rollers 59, 60. The media sheet pushes the flip guides 64, 66 out of the media path as the media sheet moves along the feed rollers 60. Beyond the flip guides 64, 66 the media sheet moves along a first media path 114. The media path 114 spans a path from rollers sleds 68/pinch rollers 70 to the metering rollers 78 and into a print zone 116. The media sheet is moved between the feed rollers 60 and the rollers sleds 68/pinch rollers 70, under the upper guide 76 and onto the metering rollers 78. Pinch rollers 80 press the media sheet to the metering rollers 78. Both the metering rollers 78 and the feed rollers 60 are moving in a forward direction 117 during the first side printing operation. Eventually a trailing edge of the media sheet M passes beyond the feed rollers 60 so that the metering rollers 78 move the media sheet. Beyond the pinch rollers 80, the media sheet is moved along a platform 118 of the pivot mechanism 82. The print source 12 is located adjacent to the platform 118. The area between the platform 118 and the print source 12 is referred to herein as the print zone 120. The media sheet M is fed through the print zone 120 into an output region 122, which in some embodiments includes an output tray 124.

For simplex printing, the media sheet is released into the output region 122. Immediately or after a suitable drying time (depending on the type of print source), another media sheet may be picked and fed along the media path through the print zone for print recording. For duplex printing, the above operation occurs for first side printing. However, for duplex printing the trailing edge 124 of the media sheet M is not released during the first-side printing. Referring to FIG. 6, while the pinch roller 80 presses the trailing edge 124 of the media sheet M to the metering roller 78, the motion of the feed rollers 60 and metering rollers 78 ceases. A suitable drying time is allowed before the drive motor 16 reverses the rotational direction of the feed rollers 60 and metering rollers 78 to a direction 121 (see FIG. 7). The sensor 40, which also serves to indicate whether the duplex media handling system is installed, in one embodiment for a wet ink print recording system (e.g., inkjet print recording) is a humidity sensor. The sensor 40 detects the ambient humidity. Controller 18 in response to the detected humidity determines a sufficient drying time before allowing the media sheet to be moved for second side printing. In alternative embodiments separate sensors are used to determine humidity and whether the duplex media handling system is installed. In other embodiments, a sensor is not included for detecting drying time (e.g., non-wet ink printing; a worst case, or even a typical case, drying time is programmed in without sensory indication). Regardless of the sensor 40 embodiment, the controller 18 includes firmware programmed to handle simplex printing or duplex printing. The sensor 40 indication of whether the duplex media handling system is installed or not installed is used by the firmware to determine whether the duplex mode is available.

The determination of when to stop the metering rollers 78 with the media sheet trailing edge grasped is now described. The simplex media handling system 14 includes a media sensor 72 and flag 74 (see FIGS. 2 and 3). When the media sheet M is moved along the first media path 114 from the feed rollers 60 toward the metering rollers 78, the lead edge of the media sheet trips the flag 74. Once the trailing edge 124 passes beyond the flag, the flag 74 returns to its unbiased position. The sensor 72 indicates when the leading edge and trailing edge of the media sheet M have passed the flag 74. These indications are detected by the controller 18 which then determines when the trailing edge 124 of the media sheet M is at the pinch roller 80. At such time the controller 18 has the drive motor 16 discontinue rotation of the feed rollers 60 and metering rollers 78. After a programmed pause (e.g., to allow for first side drying), the controller 18, then signals to the drive motor 16 to reverse the rotational directions of the feed rollers 60 and metering rollers 78 to the reverse direction 121.

Figure 7:
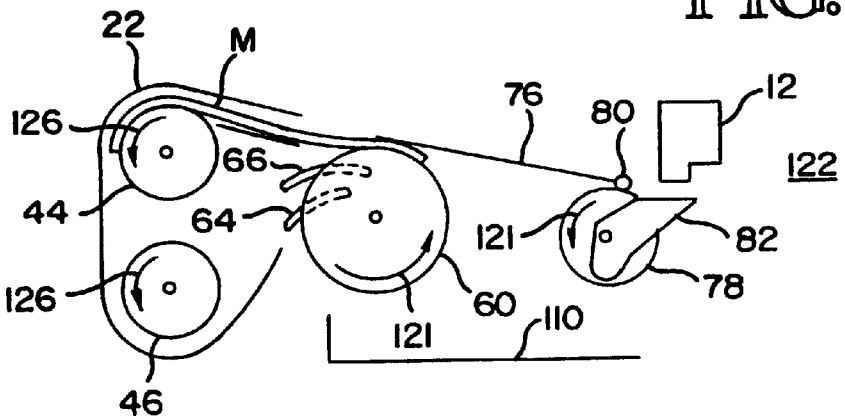
FIG. 7 is a diagram of the duplex media handling system and simplex media handing system where the media sheet is being fed back along the media path into the duplex media handling system.

Referring to FIG. 7, the metering rollers 78 feed the media sheet M back along the first media path 114 into contact with the feed rollers 60. The feed rollers 60 then continue feeding the media sheet back. Eventually the media sheet M is out of the grasp of the metering rollers 78 and fed back only by the feed rollers 60 (as distinguished from both the feed rollers 60 and metering rollers 78). As the media sheet M is fed back to and then onto the feed roller the flip guides 64, 66 are positioned in their unbiased position (see position in FIGS. 2 and 3). The unbiased position has the flip guides blocking the path around the feed rollers 60 back toward the input tray 110. Instead, the media sheet M is fed over a support surface of the flip guide 66 into the duplex media handling system module 22. The feed rollers 60 feed the media sheet M toward and onto the first drive roller 44. At the time where the controller 18 had the drive motor 16 reverse the directions of feed rollers 60 and metering rollers 78 to direction 121, such reversal action causes the transmission 48 to enter second gear (i.e., second gear 94 engages gear 95, see FIG. 4). As a result, when the media sheet is fed from the feed rollers 60 to the drive roller 44, the drive rollers 44, 46 are rotating in a direction 126. The drive roller 44 feeds the media sheet to drive roller 46. The drive rollers 44, 46, and then drive roller 46 alone feeds the media sheet along path 52 (see FIG. 3) back toward the feed rollers 60.

The duplex media handling system 22 has a media path length from entry point 54 to exit point 56 (see FIG. 3) which is at least as long as the maximum rated media sheet length for automatic duplex handling (e.g., 11 inches; 14 inches; 17 inches). If, however, automatic duplex handling is limited to a specific size, such as 11 inches or A4 paper length, then simplex printing (and manual duplex printing) may still print to larger sheets (e.g., 14 inches; 17 inches). Prior to the time the media sheet is fed out of the duplex media handling system 22 back onto the feed rollers 60, the feed rollers 60 are to change direction from reverse direction 121 back to the forward direction 117. However, the direction through the duplex media handling system module should stay the same (i.e., direction 126) even when the feed rollers 60 go back to the forward rotational direction 117. The forward rotational direction as used herein refers to the direction 117 which the feed rollers 60 rotate to move the media sheet from the feed rollers 60 to the metering rollers 78 along the first media path 114.

Figure 8:
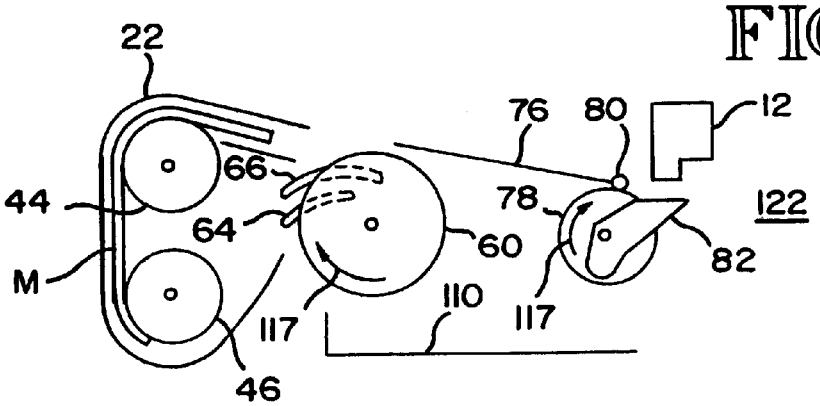
FIG. 8 is a diagram of the duplex media handling system and simplex media handing system where the media sheet is completely within the duplex media handling system and the feed rollers have reversed direction putting the transmission in neutral.

The process to change directions of the feed rollers 60 back to the forward direction 117, while the media sheet is in the duplex handling system 22, is now described. As the media sheet M is fed back along the first media path 114 from the metering rollers 78 to the feed rollers 60 (FIG. 7), the media sheet trips the secondary flag 75 which trips the flag 74 (see FIG. 3). The flag 74 is tripped, then released, as the entire media sheet passes beyond the flags 74, 75. The sensor 72 outputs such tripping indications to the controller 18. The controller knows what direction the drive motor 16 is rotating the rollers 60, 78, and thus knows that the media sheet is being fed back for duplex printing. Thus, the controller 18 knows what signification to give to the trippings of the flag 74. Once the media sheet M has passed completely beyond the flag 72, the controller 18 waits a prescribed time (based upon path length and feed speed) until the media sheet is off the feed rollers 60 and pinch rollers 71 and is driven/fed only by the drive rollers 44 (or both drive roller sets 44,46). In particular, the controller 18 waits until the media sheet is a prescribed distance beyond the feed roller into the duplex media handling system 22. At such time, the controller 18 signals the drive motor 16 to change the rotational direction of the feed rollers 60 and metering rollers 78 back to the original forward direction 117. FIG. 8 shows the media sheet M in the duplex media handling system 22 with the feed rollers 60 restarted in the opposite direction. This stopping and starting action of the feed rollers 60 (and metering rollers 78) moves the clutch 90 (see FIG. 4) causing the second gear 94 to come out of mesh. Specifically, the stopping and starting action puts the transmission 48 into neutral.

To shift the transmission 48 out of neutral, and more particularly to engage the first gear 92, rather than the second gear 94, a jogging action is performed Shortly after the drive motor changes the direction of the feed rollers 60 back to the forward direction 117, the drive motor 16 changes the direction again back to the reverse direction 121 (see FIG. 9), then forward again to direction 117 (see FIG. 10). This operation is referred to herein as a jogging action. Such jogging action causes the transmission 48 to engage the first gear 92 with gear 95 (see FIG. 4). With the first gear 92 engaged while the feed rollers 60 rotate in the forward direction, the drive rollers 44, 46 rotate in the desired direction 126 (see FIG. 10).

The relationship of the transmission 48 to the drive roller directions is summarized below:

(1) When the second gear 94 of transmission 48 is engaged and the feed rollers 60 are rotating in the reverse direction 121, the drive rollers 44, 46 rotate in the desired direction 126 (see FIG. 7).

(2) When the first gear 92 of transmission 48 is engaged and the feed rollers 60 are rotating in the forward direction 117, the drive rollers 44, 46 rotate in the desired direction 126 (see FIG. 10).

Case 1 occurs initially when the media sheet is fed into the duplex media handling system module 22. Case 2 occurs after the jogging action allowing the media sheet M to be fed from the duplex media handling system 22 back onto the feed rollers 60. Case 2 is depicted by FIG. 10.

With the feed rollers 60 and metering rollers 78 rotating in direction 117 while the drive rollers 44, 46 rotating in direction 126, the media sheet M is fed out of the duplex media handling system 22 back onto the feed rollers 60. As a lead edge of the media sheet exits the duplex media handling system 22, such edge moves the flip guide 66 out of its path allowing the media sheet to be grasped by the feed rollers 60 and pinch rollers 71 and moved back onto the first media path 114 (see FIG. 10 and FIG. 5 for first media path 114). The media sheet M goes over the flip guide 64 and under the flip guide 66. The media sheet M is fed along the first media path 114 under the upper guide 76 for top of form sensing with sensor 72 and flags 74, 75, and onto the metering rollers 78 and the platform 118, into the print zone 120 for second side print recording. The media sheet M is fed through the print zone 120 into the output region 122. The media sheet then is released into the output region 122. Immediately or after a suitable drying time (depending on the type of print source), another media sheet may be picked and fed along the media path through the print zone for simplex or duplex print recording.

Meritorious and Advantageous Effects

One advantage of the invention is that media flipping is provided without user intervention or reinsertion. Another advantage for wet ink printing is that first side media drying time may be assigned or estimated reducing the risk of wet image smear. Another advantage is that the duplex media handling system is a module which may be decoupled and removed. This allows for manufacturer customization of simplex and duplex print recording systems. Further, an end user also may remove and install the duplex media handling system module. Another feature of the duplex system 22 is a cover 45 which opens along the frame 42 allowing access to a media sheet traversing path 52. This is beneficial for clearing paper jams in the duplex system 22.

Another advantage is that additional motors are not needed for the duplex module. The duplex module is powered by the simplex media handling system. Another advantage is that additional media position sensors are not required for the duplex module. The media position sensors of the simplex media handling system are provide the sensing for controlling media moving through the duplex module.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A method for handling a media sheet for print recording, the method comprising the steps of:

feeding the media sheet along a first media path from a feed roller onto a metering roller and into a print zone for print recording onto a first side of the media sheet;

as the media sheet moves through the print zone, stopping rotation of the metering roller while a trailing edge of the media sheet is gripped by the metering roller;

reversing rotation of the metering roller;

moving the media sheet back along the first media path from the metering roller to the feed roller;

feeding the media sheet from the feed roller onto a set of duplex media handling rollers;44,46 moving the media sheet with the duplex media handling rollers along a loop media path;

feeding the media sheet from the duplex media handling rollers back onto the feed roller and along the first media path into the print zone for print recording onto a second first side of the media sheet.

2. The method of claim 1, in which the set of duplex media handling rollers are part of a duplex media handling module, the method further comprising, prior to the step of reversing rotation of the metering roller, the step of:

sensing that the duplex media handling module is installed.

3. The method of claim 1, in which the feed roller and the metering roller are linked to rotate in a common forward direction during print recording onto the first side of the media sheet and during print recording onto the second side of the media sheet, and in which the feed roller and the metering roller are linked to rotate in a common reverse direction during the steps of moving the media sheet back along the first media path from the metering roller to the feed roller, and feeding the media sheet from the feed roller onto the set of duplex media handling rollers.

4. The method of claim 1, in which the set of drive rollers are linked via a transmission to the feed roller, and further comprising, during the step of moving the media sheet with the duplex media handling rollers along the loop media path, the step of:

jogging the rotation of the feed roller from a reverse direction to a forward direction, back to the reverse direction and again to the forward direction while the media sheet is out of contact with the feed roller;

wherein during the step of jogging, the transmission is shifted into neutral to discontinue rotation of the set of drive rollers, then shifted into gear to rotate the drive rollers and move the media sheet further along the loop path; wherein prior to the step of jogging the feed roller is rotating in the reverse direction while the set of drive rollers are rotating in a first direction and after the step of jogging the feed roller is rotating in the forward direction while the set of drive rollers are rotating again in the first direction.

5. The method of claim 1, further comprising, prior to the step of moving the media sheet back along the first media path from the metering roller to the feed roller, the step of sensing ambient humidity to determine drying time for wet ink print recording to the first side of the media sheet.

6. The method of claim 2, further comprising the step of removing the duplex media handling module.

7. A print recording apparatus for recording print onto a media sheet, comprising:

a print recording source;

a simplex media handling assembly for moving a media sheet along a media path into a print zone adjacent to the print recording source to receive print recording, the simplex media handling assembly comprising a feed roller;

a drive motor for driving rotation of the feed roller;

a controller having firmware for controlling movement of the media sheet and recording of print onto the media sheet; and a removable duplex media handling module interfacing with the simplex media handling assembly to provide a media path for flipping the media sheet for second side printing.

8. The print recording apparatus of claim 7, in which the duplex media handling module comprises a sensor having an output interfaced to the controller for indicating presence of the duplex media handling module.

9. The print recording apparatus of claim 8 in which the controller allows either one of simplex print recording or duplex print recording while the sensor indicates presence of duplex media handling module, and allows simplex printing and disallows duplex print recording in the absence of said indication of presence of the duplex media handling module.

10. The print recording apparatus of claim 8, in which the sensor is a humidity sensor and the sensor output is an indication of humidity, the controller using the indication of humidity during a duplex printing operation to determine a wet ink drying time after a first side of the media sheet is printed before moving the media sheet for flipping and second side printing.

11. The apparatus of claim 7, in which the duplex media handling module further comprises a transmission for coupling the set of duplex handling drive rollers to the drive motor, the transmission having a neutral position, first position and a second position, wherein while the transmission is in the neutral position the set of duplex handling drive rollers are not engaged to rotate; wherein while the transmission is in the first position the set of duplex handling drive rollers are engaged to rotate in the same direction as the feed roller, and wherein while the transmission is in the second position the set of duplex handling drive rollers are engaged to rotate in the opposite direction as the feed roller.

12. The apparatus of claim 11, in which the controller signals the drive motor to change motion of the feed roller and cause the transmission to change positions.

13. The apparatus of claim 12, in which the duplex media handling module includes a loop path for the media sheet, and in which the controller controls the drive motor in a manner which adjusts the position of the transmission to allow the media sheet to travel only in one direction along the loop path.

14. The apparatus of claim 13 in which the loop path has a media sheet entry point and a media sheet exit point at the feed roller.

15. The apparatus of claim 7, in which the simplex media handling assembly further comprises a metering roller and linkage for coupling the drive motor to either one or both of the feed roller and the metering roller, the feed roller and metering roller coupled to rotate in common in the forward direction or in common in the reverse direction.

16. The apparatus of claim 15, in which the media path comprises a first media path from the feed roller to the metering roller and beyond the metering roller into the print zone, in which the controller comprises means for controlling the drive motor to rotate the feed roller and metering roller in a forward direction to move the media sheet in a first direction along the first media path during print recording to a first side of the media sheet and during print recording to a second side of the media sheet, the controller further comprising means for controlling the drive motor to rotate the feed roller and metering roller in a reverse direction to move the media sheet in a second direction along the first media path during an operation to move the media sheet onto the loop path.

17. The apparatus of claim 16, further comprising a flip guide for guiding the media sheet from the first media path toward the loop path as the media sheet moves in the second along the fit media path.

18. A print recording apparatus for print recording onto a media sheet, the apparatus comprising:

a media handling assembly for moving the media sheet along a media path into a print zone to receive print recording, the media handling assembly comprising a feed roller and a metering roller, the media path comprising a first media path from the feed roller to the metering roller and beyond the metering roller into the print zone;

a set of duplex handling drive rollers for routing the media sheet about a loop path during a duplex printing operation to flip the media sheet and feed the media sheet back onto the first media path for second side printing;

a drive motor for driving rotation of the feed roller, metering roller and the set of duplex handling rollers;

a controller for controlling movement of the media sheet and for controlling print recording onto the media sheet, the controller comprising means for controlling the drive motor to rotate the feed roller and metering roller in a forward direction to move the media sheet in a first direction along the first media path during print recording to the first side of the media sheet and during print recording to a second side of the media sheet, the controller further comprising means for controlling the drive motor to rotate the feed roller and metering roller in a reverse direction to move the media sheet in a second direction along the first media path during an operation to move the media sheet onto the loop path; and a flip guide for guiding the media sheet from the first media path toward the loop path as the media sheet moves in the second direction along the first media path.

19. The apparatus of claim 18, further comprising linkage for coupling the drive motor to either one or both of the feed roller and the metering roller, the feed roller and metering roller coupled to rotate in common in the forward direction or in common in the reverse direction.

20. The apparatus of claim 18, further comprising a transmission for coupling the set of duplex handling drive rollers to the drive motor, the transmission having a neutral position, first position and a second position, wherein while the transmission is in the neutral position the set of duplex handling drive rollers are not engaged to rotate; wherein while the transmission is in the first position the set of duplex handling drive rollers are engaged to rotate in the same direction as the feed roller; and wherein while the transmission is in the second position the set of duplex handling drive rollers are engaged to rotate in the opposite direction as the feed roller.

21. The apparatus of claim 20, in which the controller signals the drive motor to change motion of the feed roller and cause the transmission to change positions.

22. The apparatus of claim 20, in which the controller controls the drive motor in a manner which adjusts the position of the transmission to allow the media sheet to travel only in one direction along the loop path.

23. The apparatus of claim 18, in which the loop path has a media sheet entry point and a media sheet exit point at the feed roller.

24. The apparatus of claim 18, in which the set of duplex handling drive rollers are part of a duplex media handling module which is removable from the print recording apparatus, wherein the controller comprises means for testing whether the duplex media handling module is installed, wherein while the duplex media handling module is not installed the print recording apparatus is capable of simplex printing.

25. The apparatus of claim 24, in which the duplex media handling module further comprises a transmission for coupling the set of duplex handling drive rollers to the drive motor, the transmission having a neutral position, first position and a second position, wherein while the transmission is in the neutral position the set of duplex handling drive rollers are not engaged to rotate; wherein while the transmission is in the first position the set of duplex handling drive rollers are engaged to rotate in the same direction as the feed roller, and wherein while the transmission is in the second position the set of duplex handling drive rollers are engaged to rotate in the opposite direction as the feed roller.

26. The apparatus of claim 25, further comprising:

means for controlling the drive motor, during a duplex printing operation, to jog the rotation of the feed roller and the metering roller from the reverse direction to the forward direction, back to the reverse direction and again to the forward direction while the media sheet is along the loop path out of contact with the feed roller, wherein during the jog, the transmission is shifted into the neutral position to discontinue rotation of the set of drive rollers, then shifted into the second position to rotate the drive rollers and move the media sheet further along the loop path within the duplex media handling module, and wherein prior to the jog the feed roller is rotating in the reverse direction while the set of drive rollers are rotating in the first direction and after the jog the feed roller is rotating in the forward direction while the set of drive rollers are rotating again in the first direction to allow the media sheet to be fed along the first media path for second side printing.

27. The apparatus of claim 24, in which the flip guide is a first flip guide further comprising a second flip guide, wherein the media sheet enters the loop Pat from the feed roller supported by the first flip guide and wherein the media sheet exits the loop path onto the feed roller supported by the second flip guide.

28. The apparatus of claim 27, in which the media sheet moves the first flip guide to traverse the feed roller as the media sheet exits the loop path.

29. The apparatus of claim 24, in which the duplex media handling module comprises a sensor having an output interfaced to the controller for indicating presence of the duplex media handling module.

30. The apparatus of claim 29, in which the controller comprises firmware for allowing either one of simplex print recording or duplex print recording while the sensor indicates presence of duplex media handling module, and for allowing simplex printing and disallowing duplex print recording in the absence of said indication of presence of the duplex media handling module.

31. The apparatus of claim 29, in which the sensor is a humidity sensor and the sensor output is an indication of humidity, the controller using the indication of humidity during a duplex printing operation to determine a wet ink drying time after a fit side of the media sheet is printed before moving the media sheet for flipping and side printing.

32. A controller for a print recording system having a drive motor, a feed roller and a metering roller, the controller comprising:

means for testing whether a duplex media handling module is installed in the print recording system;

means for signalling the drive motor to rotate the feed roller and the metering roller in a forward direction to feed a media sheet along a first media path into a print zone for print recording onto a first side;

means for signalling the drive motor to stop rotation of the metering roller and feed roller while a trailing edge of the media sheet is gripped by the metering roller;

means for signalling the drive motor, when the duplex media handling module is installed, to reverse rotation of the metering roller and feed roller and engage a transmission into a gear for causing rotation of a set of duplex media handling rollers which moves the media sheet back along the first media path onto the set of duplex media handling rollers.

33. The controller of claim 32, further comprising:

means for signalling the drive motor, during a duplex printing operation, to jog the rotation of the feed roller and the metering roller from the reverse direction to the forward direction, back to the reverse direction and again to the forward direction while the media sheet is out of contact with the feed roller, wherein during the jog, the transmission is shifted into neutral to discontinue rotation of the set of drive rollers, then shifted into gear to rotate the drive rollers and move the media sheet further along a loop path within the duplex media handling module, and wherein prior to the jog the feed roller is rotating in the reverse direction while the set of drive rollers are rotating in the first direction and after the jog the feed roller is rotating in the forward direction while the set of drive rollers are rotating again in the first direction to allow the media sheet to be fed along the first media path for second side printing.

* * * * *